United States Patent [19]

Henricksen

[11] 3,991,286

[45] Nov. 9, 1976

[54] HEAT DISSIPATING DEVICE FOR LOUDSPEAKER VOICE COIL

[75] Inventor: Clifford A. Henricksen, Yorba Linda, Calif.

[73] Assignee: Altec Corporation, Anaheim, Calif.

[22] Filed: June 2, 1975

[21] Appl. No.: 582,999

[52] U.S. Cl. ..... 179/115.5 H; 179/115.5 VC

[51] Int. Cl.[2] ..... H04R 9/04; H04R 9/06

[58] Field of Search ..... 179/115.5 R, 115.5 VC, 179/115.5 H

[56] References Cited

UNITED STATES PATENTS

| | | | |
|---|---|---|---|
| 1,976,868 | 10/1934 | Voorhees | 179/115.5 R |
| 2,030,648 | 2/1936 | Meissner | 179/115.5 R |
| 2,217,177 | 10/1940 | Massa | 179/115.5 R |
| 2,442,791 | 6/1948 | Wente | 179/115.5 R |

FOREIGN PATENTS OR APPLICATIONS

| | | | |
|---|---|---|---|
| 460,064 | 1/1937 | United Kingdom | 179/115.5 R |
| 683,832 | 12/1952 | United Kingdom | 179/115.5 VC |

*Primary Examiner*—George G. Stellar
*Attorney, Agent, or Firm*—Edward A. Sokolski

[57] ABSTRACT

The coil form for a loudspeaker voice coil is made of a material having high thermal conductivity. The coil form is attached to or integrally formed with a highly thermally conductive spider member which resiliently supports the coil form on the frame structure of the speaker, which also has high thermal conductivity. In one embodiment of the invention a heat sink member to facilitate the dissipation of the thermal energy is attached to the speaker frame structure. In an embodiment involving a horn type speaker, the horn element, which is made of a thermally conductive material, is attached to the speaker frame and also functions as a heat dissipator. In this manner, the likelihood of overheating of the speaker voice coil is greatly diminished.

3 Claims, 3 Drawing Figures

HEAT DISSIPATING DEVICE FOR LOUDSPEAKER VOICE COIL

This invention relates to loudspeakers and more particularly to a device for dissipating heat generated in loudspeaker voice coils.

The voice coils of loudspeakers, where high power operating conditions are involved, often tend to overheat. This problem is particularly troublesome where the speaker is operated in a confined environment with little cool air circulation available in the region of the voice coil. The forms on which voice coils are wound generally are made of kraft paper or plastic and have little heat dissipating ability. While in certain higher power speakers, aluminum coil forms are employed, these are not used to conduct heat to an efficient heat dissipater.

Several undesirable results of the overheating of speaker voice coils are as follows: Firstly, the heat often melts the bonding material used to hold the coil windings in place, resulting in a separation of such windings from the form with the obvious undesirable consequences. Further, heating of the coil wire results in an increase in its resistivity which can substantially lower the efficiency of a speaker. Also, if the overheating becomes extreme, the coil may burn out. Despite the aforesaid problem in speakers operating under high power conditions, no good solution to this problem has been offered in the prior art.

The present invention overcomes this problem in a highly effective yet simple and economical manner by providing means for efficiently conducting the heat away from the voice coil. This is done without any significant change in the speaker design, or without any loss in the efficiency and fidelity of speaker operation.

It is therefore an object of this invention to increase the efficiency of speaker operation, particularly under high power operating conditions.

It is a further object of this invention to lessen failures in loudspeaker voice coils.

It is still another object of this invention to provide means for efficiently dissipating heat generated in a loudspeaker voice coil to prevent overheating thereof.

Other objects of this invention will become apparent as the description proceeds in connection with the accompanying drawings, of which:

Briefly described, the device of the invention is as follows: A speaker voice coil form is fabricated of a material having high thermal conductivity, such as a suitable metal. The speaker spider structure which supports the voice coil form from the speaker frame is also made of a highly thermally conductive material and may be integrally formed with the voice coil. The speaker frame structure which is also made of metal receives the thermal energy and acts to dissipate such energy. In situations where the frame is incapable of achieving the desired dissipation, a heat sink is attached thereto to facilitate the removal of the heat energy. In an embodiment involving a horn type speaker, the metal horn element which is attached to the speaker frame also aids in the heat dissipation.

Figure 1:
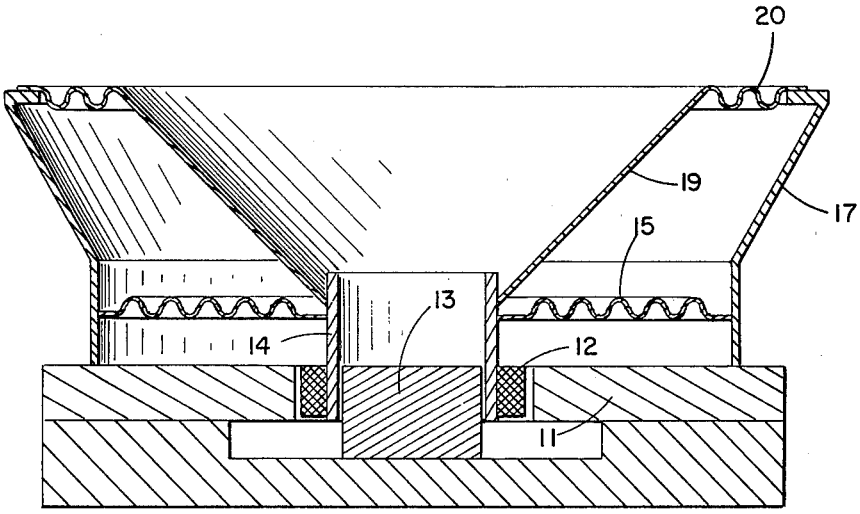
FIG. 1 is a cross sectional schematic view of a first embodiment of the invention.

Referring now to FIG. 1, a first embodiment of the invention is shown as incorporated into a conventional cone type loudspeaker. Speaker voice coil 12 is wound around form 14, form 14 being fabricated of a highly conductive material such as aluminum or copper. The voice coil wire has an insulating coating of a material such as shellac, varnish or epoxy material, the coil windings being cemented to the coil form. Fixedly attached to coil form 14 is spider element 15 which is also fabricated of a highly conductive material such as aluminum or copper. Spider element 15 as noted has circular corrugations formed therein and resiliently supports coil form 14 from speaker frame or basket 17. To provide the desired resiliency, spider 15 may be fabricated of a suitable aluminum or copper foil material. Spider 15 may in certain instances be integrally formed with coil form 14. The speaker cone 19 may be fabricated of a suitable material and is attached to coil form 14 at one end and to the speaker surround 20 at the other. Surround 20 is fixedly attached to frame structure 17. The speaker frame structure or basket 17 is made of a metal material which is a good heat dissipater. Voice coil 12 operates in conventional fashion in the gap between the pole pieces formed by magnetic members 11 and 13 to cause mechanical actuation of the coil, coil form and cone in accordance with the electrical signals fed to the coil.

As can be seen, the heat generated in voice coil 12 is conducted away from the coil by means of thermally conductive voice coil form 14 and spider 15 to conductive frame structure 17 which operates to dissipate the heat energy. If heat dissipation beyond the capacity of the frame is required, a heat sink member, as to be described in connection with the embodiment of FIG. 3, can be attached to the speaker frame. For additional cooling, a blower can be used to circulate air to the heat sink. Thus as can be seen, heat energy is efficiently removed from the voice coil to avoid overheating thereof.

Figure 2:
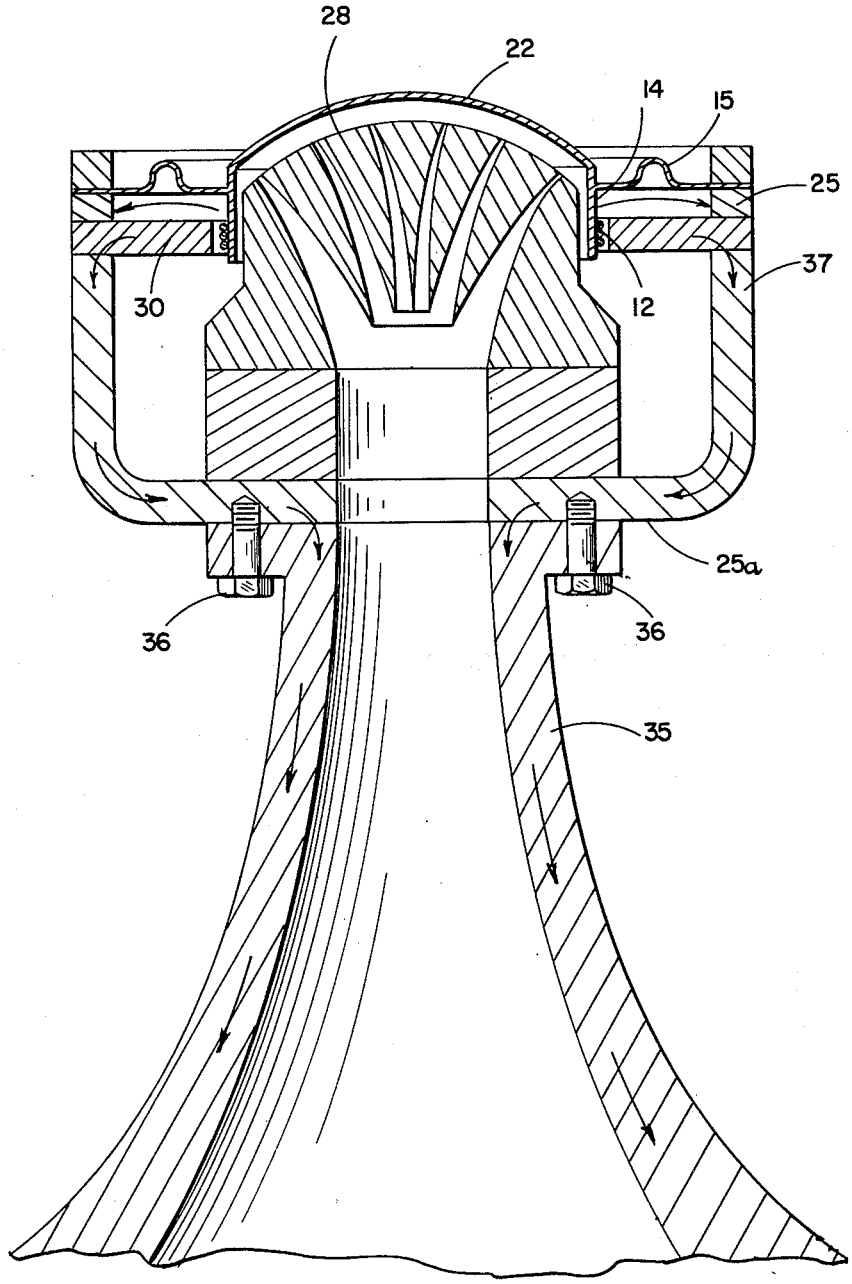
FIG. 2 is a cross sectional schematic view of a second embodiment of the invention.

Referring now to FIG 2, a second embodiment of the invention is illustrated, this embodiment being incorporated into a horn type speaker. Voice coil 12 is wound around coil form 14 which is fabricated of a highly thermally conductive material such as aluminum or copper. As for the previous embodiment, the wire of coil 12 is coated with a suitable insulating material such as varnish, and the coil windings cemented to the form. Fixedly attached to or integrally formed with coil form 14 is diaphragm member 22 which may be fabricated of a thermally conductive metallic material. Coil form 14 and diaphragm 22 are resiliently supported on frame 25 by means of spider element 15. This spider element is fabricated of a highly thermally conductive material such as copper or aluminum and is fixedly attached to coil form 14 so that it makes good thermal contact therewith. Voice coil 12 is supported in the magnetic gap formed between circularly shaped magnetic pole plate element 30 and phasing plug 28 which also forms a pole piece. Phasing plug 28 is designed, as is well known in the art, to couple the sound energy generated by means of diaphragm 22 in response to the movement of voice coil 14 in the magnetic gap, to the throat of horn 35. Horn 35 is attached to the magnetic portion 25a of the frame by means of bolts 36. Horn 35 is made of a highly thermally conductive material such as aluminum. Heat energy generated in voice coil 12 is conducted, as indicated by arrows 37, by means of coil form 14 and spider element 15 to frame 25. The heat energy is conducted from magnetic frame portion 25a of the driver to horn 35 which operates to dissipate the heat energy in conjunction with the driver casing.

Figure 3:
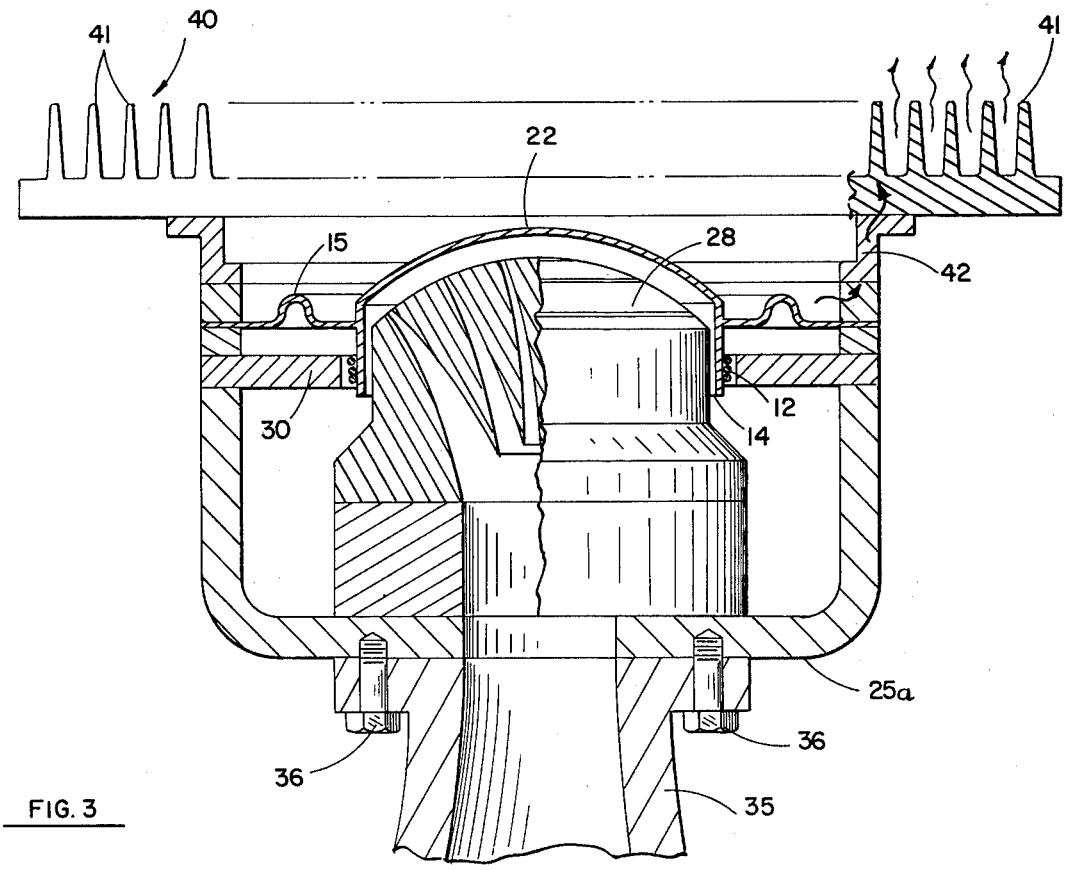
FIG. 3 is a schematic cross sectional view of a third embodiment of the invention.

Referring now to FIG. 3, a further embodiment of the invention is illustrated. This embodiment is similar to the last described embodiment except that a heat sink 40 is added to aid in the heat dissipation. Heat sink 40 is fixedly attached to frame 25 of the driver by means of rectangular thermally conductive bracket member 42. Heat sink 40 is of conventional design and has a plurality of heat dissipating fins 41 formed therein. The heat sink thus further facilitates the elimination of the heat from the voice coil. In situations where extreme heating problems are encountered, a blower unit can be added to circulate air over the fins 41 of heat sink 40.

The device of the invention thus provides highly efficient means for preventing the voice coil of a speaker from overheating, this end result being achieved without a significant alteration of the acoustical design of the speaker and without the addition of significant cost to the fabrication.

While the invention has been described and illustrated in detail, it is to be clearly understood that this is intended by way of example and illustration only and is not to be taken by way of limitation, the spirit and scope of this invention being limited only by the terms of the following claims.

I claim:

1. In a loudspeaker, means for forming a magnetic gap, means for generating magnetic flux across said gap, a coil form of a metal having high thermal conductivity, a voice coil being wound directly on said form with the windings of said coil electrically insulated from each other and from said coil form, a frame structure, a spider fabricated of a highly conductive metal and having convoluted means concentric with said voice coil form for resiliently supporting said coil form from said frame structure with said coil positioned in the magnetic gap, said spider having high thermal conductivity and forming a heat path between the coil form and the frame structure, and a heat sink member having heat dissipating fins, said heat sink member being attached to the frame structure in good thermal contact therewith, whereby heat energy is efficiently conducted from said voice coil to the frame structure through the coil form and spider.

2. The loudspeaker of claim 1 wherein said loudspeaker includes a horn of a metal having high thermal conductivity, said horn being attached to said frame structure in good thermal contact therewith so as to conduct away heat energy therefrom.

3. The loudspeaker of claim 1 wherein said coil form and said spider are fabricated of aluminum.

* * * * *